United States Patent [19]

Goodman et al.

[11] Patent Number: 5,062,645

[45] Date of Patent: Nov. 5, 1991

[54] FITNESS AND NUTRITION GAME APPARATUS AND METHOD OF PLAY

[76] Inventors: Meri Goodman, 14 Clover Pl., Cos Cob, Conn. 06807; Phyllis Schondorf, 21 Herthstone Dr., Riverside, Conn. 06878

[21] Appl. No.: 608,818

[22] Filed: Nov. 5, 1990

[51] Int. Cl.[5] ..... A63F 3/00; A63F 9/18; G09B 19/00

[52] U.S. Cl. ..... 273/249; 273/290; 273/431; 434/127

[58] Field of Search ..... 273/249, 298, 243, 242, 273/290; 434/127

[56] References Cited

U.S. PATENT DOCUMENTS

| | | | |
|---|---|---|---|
| 4,090,717 | 5/1978 | Rossetti | 273/249 |
| 4,344,625 | 8/1982 | Frudakis | 273/242 |
| 4,557,485 | 12/1985 | Lardon | 273/249 |
| 4,718,675 | 1/1988 | Rosenberg et al. | 273/243 |
| 4,824,117 | 4/1989 | Russell | 273/248 |
| 4,932,666 | 6/1990 | Corle | 273/249 |

FOREIGN PATENT DOCUMENTS

| | | | |
|---|---|---|---|
| 677949 | 7/1939 | Fed. Rep. of Germany | 273/290 |

*Primary Examiner*—Benjamin Layno
*Attorney, Agent, or Firm*—Iman Abdallah

[57] ABSTRACT

A fitness and nutrition education game apparatus and method of play. The game apparatus includes a playing board having a playing path defined by a plurality of contiguous spaces; a set of playing pieces that are separate representations of an obese body image, a chubby body image and a slim body image; a die; a first plurality of playing cards each having printed thereon a first question of moderate difficulty about nutrution, diet, exercise and fitness and the corresponding answer; and a second plurality of playing cards each having printed thereon a second question of advanced difficulty about nutrition, diet, exercise and fitness and the corresponding answer.

Play is conducted by advancing the playing piece along the playing path for the number of spaces determined by a throw of the die. Player directives marked on the contiguous spaces further determine the number of spaces and direction that a playing piece advances. When a playing piece lands on a space having a player directive to select and answer a first question about nutrition, diet, exercise and fitness, the playing piece can be advanced only by correctly answering the question. When a playing piece lands on a space having a player directive to select and answer a second question about nutrition, diet, exercise and fitness and the player correctly answers the second question, a body image can be exchanged for a more fit body image and the player can advance the playing piece.

5 Claims, 3 Drawing Sheets

FITNESS AND NUTRITION GAME APPARATUS AND METHOD OF PLAY

BACKGROUND OF THE INVENTION

The present invention generally relates to boardgames and in particular to nutrition and fitness education boardgames.

A dieting game board apparatus is disclosed in U.S. Pat. No. 4,040,628 to Pope which emphasizes positive and negative steps for dieting. The Pope game board apparatus includes chance generating means, a plurality of playing pieces representing a dieter, weight recording means for each dieter which functions as a scoring device, a playing board having a plurality of playing spaces in substantially contiguous relationship defining a playing path, a first plurality of spaces indicating a weight gain, and a second plurality of spaces indicating a weight loss. A second embodiment of the dieting game board apparatus of the Pope invention further includes a supply of game money, a plurality of weight cards having player directives, at least one space where weight can be lost for payment of money, at least one space where weight can be gained for payment of money, and at least one space indicating that a player is to follow the directives of a weight card. Players move their playing pieces along the playing path for the number spaces indicated by the chance generating means and mark the weight recording means in turn. The winner is the first player to reduce his/her weight to zero, or in the second embodiment, the first player to lose twenty-five pounds.

In U.S. Pat. No. 4,159,117 to Kuna a boardgame designed around the theme of gaining and losing weight and counting calories is disclosed. The Kuna boardgame includes a game board having a plurality of stations defining a travel path, hollow playing pieces, a plurality of weight elements receivable within the hollow playing pieces as representations of calories, chance means which determine the number of stations traversed on a turn and the number of weight elements added to a playing piece, scale means for comparing the weight of opposing playing pieces, and second chance means to provide random gains or losses of calories. The object of the game is to finish with the least number of accumulated calories.

U.S. Pat. No. 4,174,840 to Curtiss discloses a weight control game apparatus which emphasizes the relationship between food consumption and exercise in weight control. The Curtiss game apparatus includes a gameboard for each player which has a calories gain path and a calories loss path. Chance card means determine which path a player moves along for a number of spaces based on a roll of dice. The player having lost the greatest amount of calories or gained the least amount of calories is the winner.

A nutrition education game is disclosed in U.S. Pat. No. 4,398,721 to McKay. The McKay game includes playing pieces, chance-determining means, a gameboard having a plurality of spaces defining a playing path, each space having an indicia of a nutritional feature associated with different types of food marked thereon, for example a low salt content side dish, a plurality of cards identifying a food and a value for a particular nutritional feature associated with that food, and a score card to tally the amount of a nutritional features accumulated. The player accumulating the most nutritional score, for example the lowest total salt content, is the winner.

From the foregoing it can be seen that the diet and nutrition education boardgames of the prior art have the winning results determined by chance. In addition to chance means determining the number of spaces that a playing piece traverses, in the Pope boardgame randomly-selected weight cards determine a player's fate; in the Kuna boardgame the chance means also determine the caloric intake of a player; in the Curtiss game apparatus chance cards determine whether a player proceeds along a calories gain path or along a calories loss path; and in the McKay game randomly-selected cards for a food and its nutritional value determine the accumulated nutritional score. Also, in the prior art diet and nutrition education boardgames reward is delayed until the end of the game. Interim rewards as incentives are preferred if the knowledge and principles are to be applied to real life situations.

SUMMARY OF THE INVENTION

The present invention is a game apparatus and method of play for a fitness and nutrition education game having as a primary objective to provide fun and education in a realistic system of rewards and penalties determined substantially by choice. The game is played by two to six players and advancement within the game depends on knowledge about fitness and nutrition as well as chance. As in real life, players can regain lost weight based on choices made during progression of a game. The first player to complete the playing path, which culminates in the slimmest, most fit body image, is the winner.

The game apparatus of the present invention includes a playing board having a plurality of contiguous playing spaces defining a playing path. Player directions are marked on the various playing spaces and two "fitness centers" are marked between two adjacent contiguous playing spaces at approximately one-third and two-thirds the distance from the starting space. The "fitness centers" define points along the playing path where a player can "shed" a body image reflecting weight loss. A set of three playing pieces are provided for each player, each set of playing pieces comprising representations of an obese body image, a chubby body image, and a slim body image. The three body images may be nested or separately attachable to a playing piece stand. The game apparatus further includes chance means, preferably a die, a plurality of at least two hundred "Nutrition Nugget" playing cards each having a question of moderate difficulty about nutrition, diet and exercise and answer thereto printed thereon, and a plurality of at least fifty "Golden Nugget" playing cards each having a question of advanced difficulty about nutrition, diet and exercise and answer thereto printed thereon.

Several of the contiguous spaces along the playing path are marked "Nutrition Nugget" and "Golden Nugget" to indicate that when a playing piece lands on these spaces a "Nutrition Nugget" playing card or a "Golden Nugget" playing card, respectively, must be selected and the question printed thereon correctly answered before the player can advance his/her playing piece. The spaces marked "Golden Nugget" are located at only three positions along the playing path: (1) immediately preceding the two "fitness centers" and (2) at the next to last space along the playing path. The spaces marked "Nutrition Nugget" are randomly disposed along the playing path.

DESCRIPTION OF A PREFERRED EMBODIMENT

Figure 1:
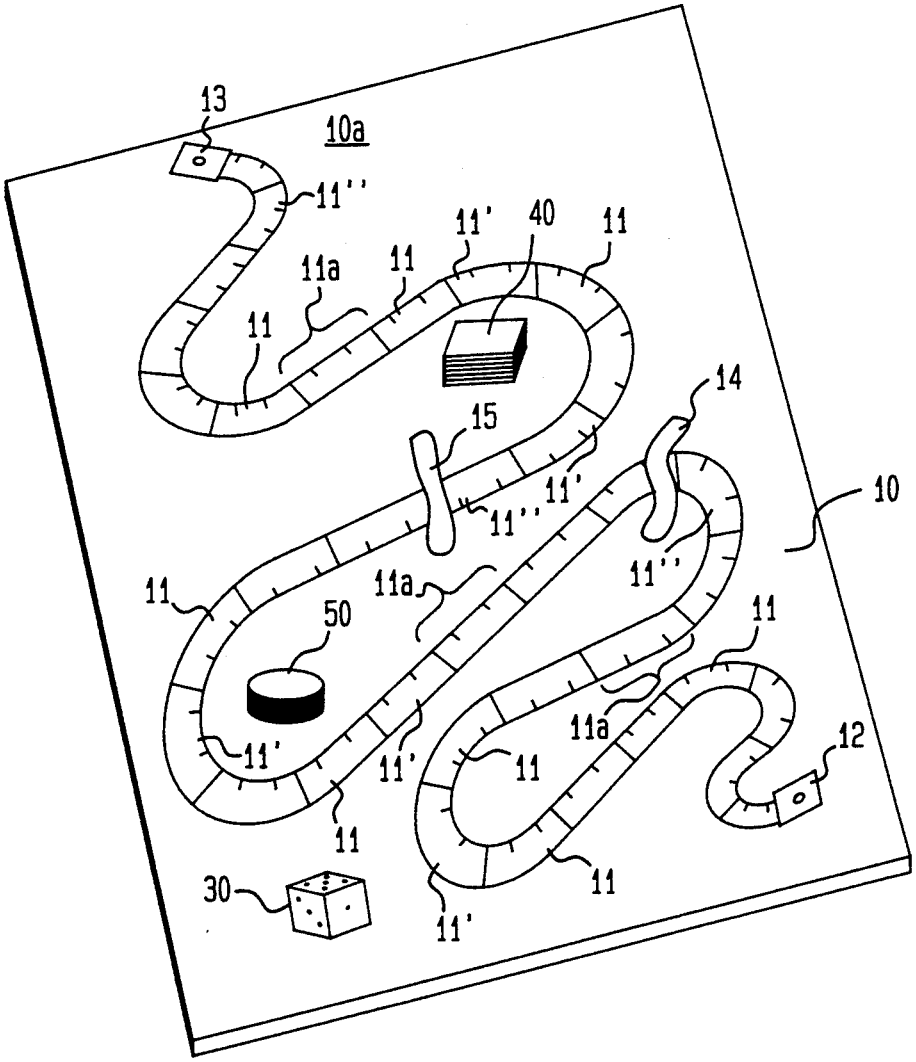
FIG. 1 is a perspective view of the playing board of the game apparatus of the present invention.

The fitness and nutrition game apparatus of the present invention comprises a playing board 10, a set of playing pieces 20 for each player (FIGS. 4 and 5), chance means 30, a plurality of "Nutrition Nugget" playing cards 40 and a plurality of "Golden Nugget" playing cards 50. FIG. 1 illustrates in a perspective view the playing board 10 having the chance means 30, "Nutrition Nugget" playing cards 40 and "Golden Nugget" playing cards 50 disposed thereon.

Playing board 10 has a plurality of contiguous spaces 11 printed on the upper surface 10*a* thereof defining a playing path. In the preferred embodiment of the playing board 10 illustrated in FIG. 1 the plurality of contiguous spaces 11 follow a generally serpentine path between a starting position 12 and an ending position 13. The plurality of contiguous spaces 11 is graphically representative of a tape measure having appropriate incremental markings 11*a* on said spaces 11. The playing board 10 further includes representations of a first "fitness center" 14 and a second "fitness center" 15 printed thereon which are disposed between selective adjacent contiguous spaces 11. The first "fitness center" 14 is located approximately one-third of the distance traversed by said contiguous spaces 11 as measured from the starting position 12. The second "fitness center" 15 is located approximately one-third of the distance traversed by said contiguous spaces 11 as measured from the ending position 13.

Various of the contiguous spaces 11*b* of the playing board 10 have player directives printed thereon which instruct the player whose playing piece 20 lands on that space. A partial exemplary listing of player directives is shown below:

1. You went for a walk instead of raiding the fridge, go again.
2. You started an exercise program, advance two spaces.
3. You bought pants two sizes too large; you could lose the weight, go back two spaces.
4. You jogged one mile, advance one space.
5. Lose a turn.
6. You bicycled for an hour, advance two spaces.
7. You hid candy in the piano bench, go back two spaces.
8. You lost ten pounds, go again!
9. You ate the cold pizza instead throwing it out, go back one space.
10. You lost twenty pounds, treat yourself to a massage.

The same player directive may appear on more than one of the contiguous spaces 11*b* of the playing board 10.

Figure 2:
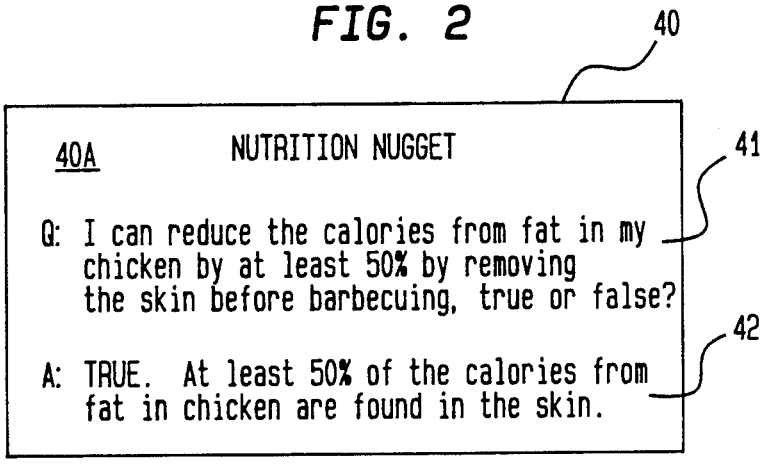
FIG. 2 is a top plan view of the face of a "Nutrition Nugget" playing card.

"Nutrition Nugget" playing spaces 11' of the contiguous playing spaces 11 have the words "Nutrition Nugget" printed thereon which instruct the player whose playing piece 20 lands on that space to select a "Nutrition Nugget" playing card 40 and correctly answer the first question 41 (FIG. 2) printed thereon before advancing a playing piece 20 as hereinafter described. The "Nutrition Nugget" playing spaces 11' are randomly disposed along the playing path. FIG. 2 illustrates in a top plan view the face 40*a* of a "Nutrition Nugget" playing card 40. Printed thereon is a first nutrition, diet, exercise or fitness question 41 and the correct first answer 42 to the first question 41. The first question 41 printed on a "Nutrition Nugget" playing card 40 is of moderate difficulty and is designed to test a player's knowledge of general nutrition, diet, exercise or fitness principles. An exemplary first question 41 and first answer 42 printed on a "Nutrition Nugget" playing card 40 is shown below:

Q: I should use foods labeled "low-cholesterol" because they are all good for my heart, true or false?

A: FALSE. Foods low in cholesterol may still be high in fat content. Margarine and vegetable oil, for example, are cholesterol-free but are high in caloric content because of fat. Foods low in cholesterol may also be high in saturated fat which raises blood cholesterol. Tropical oils such as coconut oil, palm oil and palm kernel oil used in processed foods are examples of foods high in saturated fat.

Figure 3:
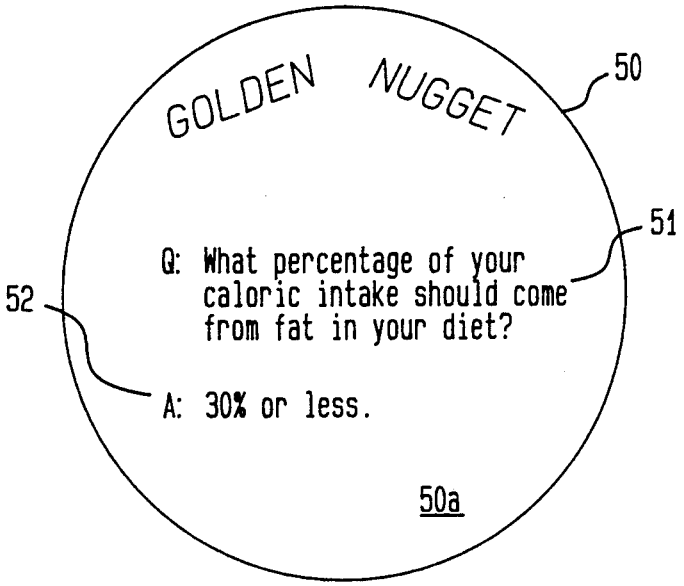
FIG. 3 is a top plan view of the face of a "Golden Nugget" playing card.

A further example of a first question 41 and first answer 42 is illustrated in FIG. 2. As can be understood from the foregoing, the first answer 42 printed on a "Nutrition Nugget" playing card 40 provides valuable information beyond that required to correctly answer the first question 41. Thus, by playing the game of the present invention players can become educated to important nutrition, diet, exercise and fitness principles. "Golden Nugget" playing spaces 11' of the contiguous playing spaces 11 have the words "Golden Nugget" printed thereon which instruct the player whose playing piece 20 lands on that space to select a "Golden Nugget" playing card 50 and correctly answer the second question 51 (FIG. 3) printed thereon before advancing a playing piece 20 as hereinafter described. There are only three "Golden Nugget" playing spaces 11'' on the playing board 10. Two of the "Golden Nugget" playing spaces 11'' are located immediately preceding the respective first and second "fitness centers" 14, 15. The third "Golden Nugget" playing space 11'' is located at the next to last playing space adjacent to the ending position 13. FIG. 3 illustrates in a top plan view the face 50*a* of a "Golden Nugget" playing card 50. Printed thereon is a second nutrition, diet, exercise or fitness question 51 and the correct second answer 52 to that second question 51. The second question 51 printed on a "Golden Nugget" playing card 50 is of advanced difficulty (relative to the first question 41 printed on a "Nutrition Nugget" playing card 40) and is designed to test the player's knowledge of more advanced nutrition, diet, exercise or fitness principles. An exemplary second question 51 and second answer 52 printed on a "Golden Nugget" playing card 50 is shown below and illustrated in FIG. 3:

Q: What percentage of your caloric intake should come from fat in your diet?

A: 30% or less.

As described in greater detail hereinafter, a player cannot advance a playing piece 20 past either the first or second "fitness center" 14 or 15 without selecting a "Golden Nugget" playing card 50 and giving the correct second answer 52 posed by the second question 51 printed thereon. Likewise, to advance a playing piece 20 past the "Golden Nugget" playing space 11'' at the next to last space adjacent to the ending position 13 a player must select a "Golden Nugget" playing card 50 and give the correct second answer 52 posed by the second question 51 printed thereon.

Figure 4:
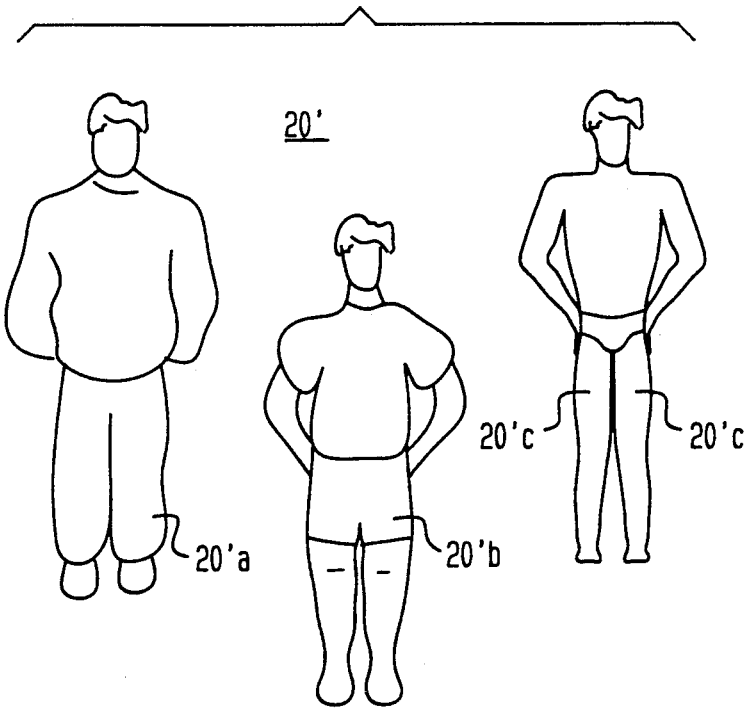
FIG. 4 is a front plan view of a first set of playing pieces.
Figure 5:
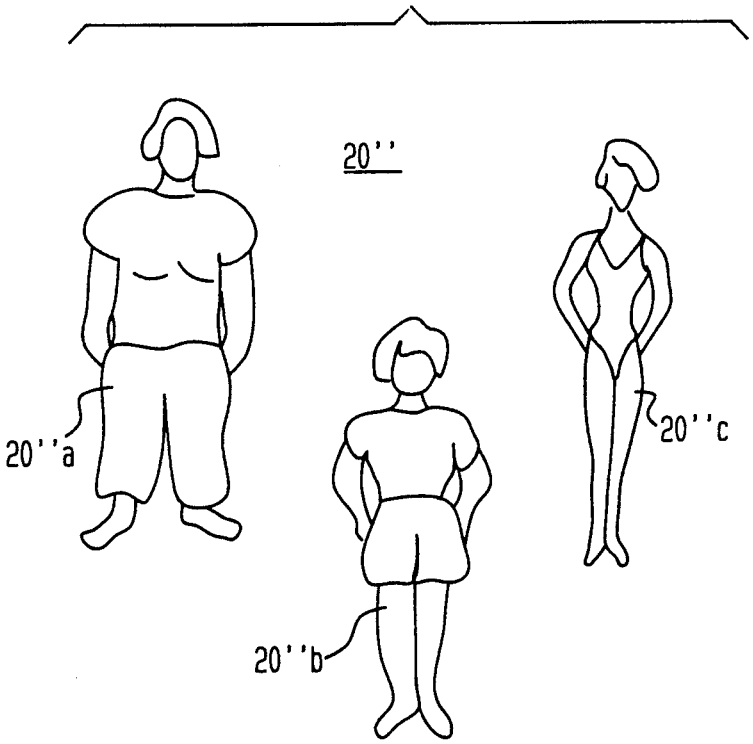
FIG. 5 is a front plan view of a second set of playing pieces.

First and second sets of playing pieces 20' and 20'' for each player are illustrated in FIG. 4 and FIG. 5. A set of playing pieces 20' or 20'' includes three representations of distinct body images: an obese body image representation 20'*a*, 20''*a*; a chubby body image representation 20'*b*, 20''*b*; and a slim body image representation 20'*c*, 20''*c*. In the first set of playing pieces 20' illustrated in FIG. 4 the representations of body images 20'*a*, 20'*b*, 20'*c* are male representations. In the second set of playing pieces 20'' illustrated in FIG. 5 the representations of body images 20''*a*, 20''*b*, 20''*c* are female representations. The plurality of playing pieces 20 for play of the game of the present invention preferably includes both male representations as illustrated for the first set of playing pieces 20' and female representations as illustrated for the second set of playing pieces 20''. A player starts the game using an obese body image representation 20'*a* or 20''*a*. As the player advances past the first "fitness center" 14 the obese body image representation 20'*a* or 20''*a* is exchanged for a chubby body image representation 20'*b* or 20''*b*. As the player advances past the second "fitness center" 15 the chubby body image representation 20'*b* or 20''*b* is exchanged for a slim body image representation 20'*c* or 20''*c*. Accordingly, interim rewards are provided in the form of acquiring more fit body images. A player may regress to an earlier body image if a nutritional regimen is not maintained.

Figure 6:
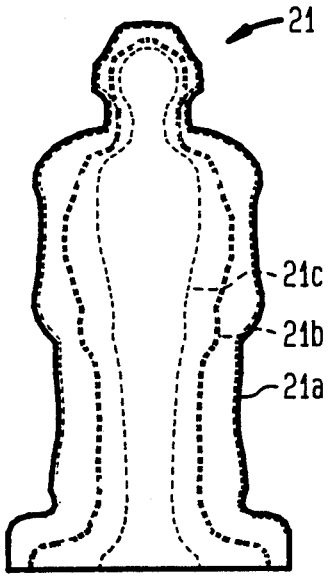
FIG. 6 is a second embodiment of a set of playing pieces.

An alternative set of playing pieces 21 is illustrated in FIG. 6. The alternative set of playing pieces 21 include an obese body image representation 21*a*, a chubby body image representation 21*b* and a slim body image representation 21*c* which are nestable. As play progresses as heretofore described, the obese body image representation 21*a* is removed to reveal the chubby body image representation 21*b*, and the chubby body image representation 21*b* is removed to reveal the slim body image representation 21*c*.

Figure 7:
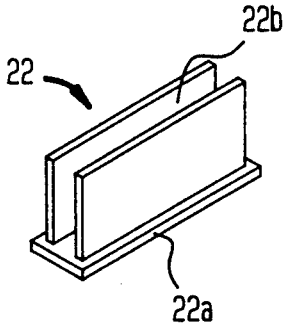
FIG. 7 is a perspective view of a playing piece stand.

FIG. 7 illustrates in a perspective view a playing piece stand 22 utilized to maintain the playing pieces 20 in an upright position. Playing piece stand 22 has a planar foot portion 22*a* which sits adjacent to the playing board 10 and a vertical slot 22*b* which receives the body image representations of the set of playing pieces.

As should be generally understood from the foregoing, a player advances his/her playing piece 20 around the contiguous playing spaces 11 in accordance with the chance means 30. The player then follows the directives on the playing space upon which (s)he lands. If a player lands on a "Nutrition Nugget" playing space 11' an opposing player selects a "Nutrition Nugget" playing card 40 and reads the first question 41. The player that landed on the "Nutrition Nugget" playing space 11' must then give the correct first answer 42. If the correct first answer 42 is given that player continues play for another turn and moves his/her playing piece 20 for a number of spaces as determined by the chance means 30. If the correct first answer 42 is not given, that player stops and on the next or subsequent turns in lieu of movement as determined by the chance means 30 that player must answer a first question 41 until a correct first answer 42 is given. A player cannot advance past a "Nutrition Nugget" playing space 11' (if (s)he lands thereon) without giving a correct first answer 42 to a first question 41.

A player cannot advance past either the first or second "fitness centers" 14, 15 without selecting a "Golden Nugget" playing card 50 and giving the correct second answer 52 to a second question 51 posed thereon. Therefor when a player rolls a number on the chance means 30 which lands him/her on a "Golden Nugget" playing space 11'' or which would advance the player past a "fitness center" 14, 15, the player must first stop at the "Golden Nugget" playing space 11'' and give the correct second answer 52 to a second question 51. If the player gives the correct answer 52 a body image is exchanged—an obese body image representation 20'*a*, 20''*a* is exchanged for a chubby body image representation 20'*b*, 20''*b* at the first "fitness center" 14, and a chubby body image representation 20'*b*, 20''*b* is exchanged for a slim body image representation 20'*c*, 20''*c* at the second "fitness center" 15—as the player advances past the respective first and second "fitness centers" 14, 15. A player must remain at the "Golden Nugget" playing space 11'' until a correct second answer 52 to a second question 51 is given. Although no body image is shed at the "Golden Nugget" playing space 11'' located next to the last space adjacent to the ending position 13, a player must still give a correct second answer 52 to a second question 51 before advancing.

Various changes and modifications to the present invention may be made without departing from the spirit and scope of the present disclosure. Such changes and modifications within a fair reading of the following claims are intended as part of the present disclosure.

Therefore, in view of the foregoing, I claim:

1. A fitness and nutrition education game apparatus comprising a playing board having a plurality of contiguous playing spaces disposed thereon defining a playing path, said playing spaces having player directives marked thereon, said player directives including directions to select one of a first plurality of playing cards and directions to select one of a second plurality of playing cards, said playing board further having two stations marked thereon disposed between adjacent contiguous playing spaces at spaced locations, said stations defining points along said playing path where a player can change body image representations in accordance with the rules of play;

a set of playing pieces for each player comprising separate representations of respective body images, said body image representations being nestable;

chance means for determining the number of spaces a player can advance a playing piece along the playing path;

a first plurality of playing cards each having printed thereon a first question of moderate difficulty about nutrition, diet, exercise and fitness and a corresponding first answer to the first question; and a second plurality of playing cards each having printed thereon a second question of advanced difficulty about nutrition, diet, exercise and fitness and a corresponding second answer to the second question.

2. A fitness and nutrition education game apparatus comprising a playing board having a plurality of contiguous playing spaces disposed thereon defining a playing path that follows a generally serpentine path between a starting position and an ending position and a first station and a second station disposed thereon between adjacent contiguous spaces located respectively at substantially one-third and two-thirds the length of said playing path as measured from the starting position, said playing spaces having player directives marked thereon, said player directives including directions to select one of a first plurality of playing cards and directions to select one of a second plurality of playing cards, said directions to select one of a second plurality of playing cards being located on respective playing spaces immediately preceding said first station and said second station and on a playing space immediately preceding the next to last playing space adjacent to the ending position;

a set of playing pieces for each player comprising three separate body image representations shaped in the form of a human being, said separate body image representations including an obese body image representation, a chubby body image representation and a slim body image representation, said separate representations being nestable;

a die;

a first plurality of playing cards each having disposed thereon a first question of moderate difficulty about nutrition, diet, exercise and fitness and a corresponding correct first answer to the first question; and a second plurality of playing cards each having disposed thereon a second question of advanced difficulty about nutrition, diet, exercise and fitness and a corresponding correct second answer to the second question.

3. A method of play for a fitness and nutrition education game comprising advancing a playing piece comprising a representation of a body image along a playing path formed by a plurality of contiguous spaces for a number of spaces determined by a throw of a die;

advancing a playing piece along said playing path in accordance to player directives marked on said contiguous playing spaces;

advancing a playing piece along said playing path by correctly answering a first question of moderate difficulty about nutrition, diet, exercise and fitness;

advancing a playing piece along said playing path by correctly answering a second question of advanced difficulty about nutrition, diet, exercise and fitness; and exchanging said playing piece for a playing piece comprising a representation of a more fit body image as a reward for correctly answering said second question of advanced difficulty about nutrition, diet, exercise and fitness.

4. A method of play for a fitness and nutrition education game as in claim 3 wherein the step of exchanging said playing piece for a playing piece comprising a representation of a more fit body image is performed at at least twice during play.

5. A method of play for a fitness and nutrition education game comprising advancing a nested set of playing pieces comprising an obese body image representation, a chubby body image representation and a slim body image representation along a playing path formed by a plurality of contiguous spaces for a number of spaces determined by a throw of a die;

advancing said set of playing pieces along said playing path in accordance to player directives marked on said contiguous playing spaces;

advancing said set of playing pieces along said playing path by correctly answering a first question of moderate difficulty about nutrition, diet, exercise and fitness;

advancing said set of playing pieces past a first station and a second station along said playing path by correctly answering a second question of advanced difficulty about nutrition, diet, exercise and fitness; and removing said obese body image representation from said set of playing pieces at said first station as a reward for correctly answering a said second question of advanced difficulty about nutrition, diet, exercise and fitness; and removing said chubby body image representation from said set of playing pieces at said second station as a reward for correctly answering a said second question of advanced difficulty about nutrition, diet, exercise and fitness.

* * * * *